United States Patent [19]

Ruiz

[11] 4,117,795

[45] Oct. 3, 1978

[54] MULTI-HULL SELF RESCUING SYSTEM

[76] Inventor: Carlos Santiago Ruiz, PROMSA P.O. Box 1478, San Salvador, El Salvador

[21] Appl. No.: 807,633

[22] Filed: Jun. 17, 1977

[51] Int. Cl.[2] ..... B63B 43/10

[52] U.S. Cl. ..... 114/68; 114/39; 114/61

[58] Field of Search ..... 114/39, 61, 68–69, 114/90–91, 102, 124, 125, 44; 9/6 P

[56] References Cited

U.S. PATENT DOCUMENTS

| | | | |
|---|---|---|---|
| 3,141,435 | 7/1964 | Moffitt, Jr. | 114/61 |
| 3,370,560 | 2/1968 | Lucht | 114/39 |
| 3,865,061 | 2/1975 | Newman | 114/39 |

*Primary Examiner*—Trygve M. Blix
*Assistant Examiner*—Jesus D. Sotelo
*Attorney, Agent, or Firm*—Jacob Shuster

[57] ABSTRACT

A marine craft maintained floating in a capsized condition by flotation components which permit angular displacement substantially about a rotational axis established intermediate the bow and stern. Venting of air entrapped within the craft forwardly of the rotational axis initiates angular displacement of the hull until the craft assumes a stabilized position intermediate the capsized and upright positions. Continued angular displacement of the craft toward the upright position is induced by upward pivotal displacement of a counterweight suspended by a boom pivotally connected to the craft to establish the rotational axis.

20 Claims, 10 Drawing Figures

Fig. 1
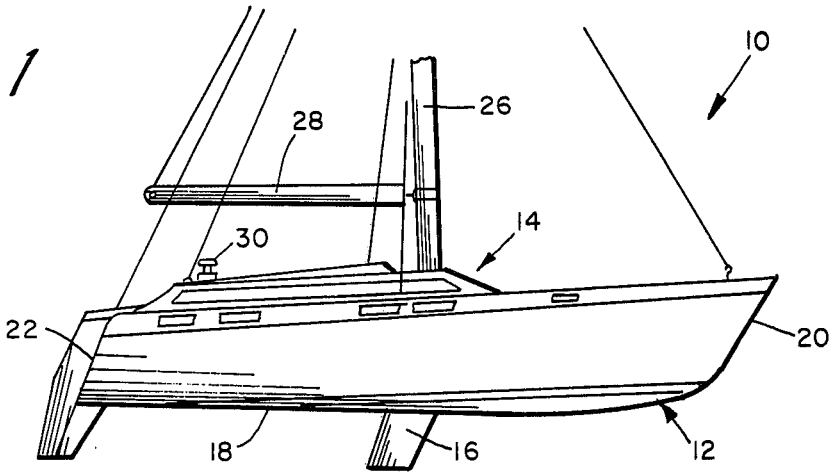
Fig. 3
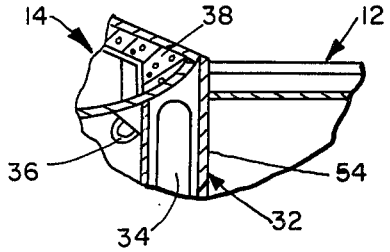
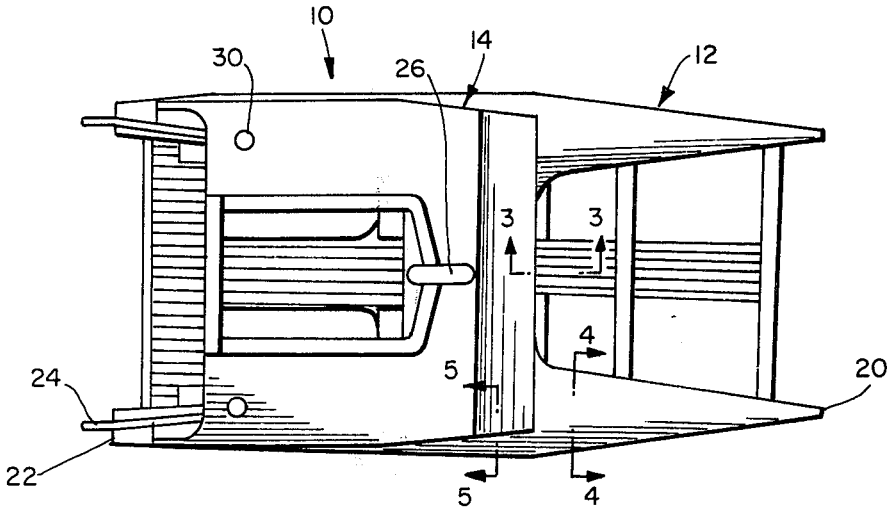
Fig. 2

Fig. 6
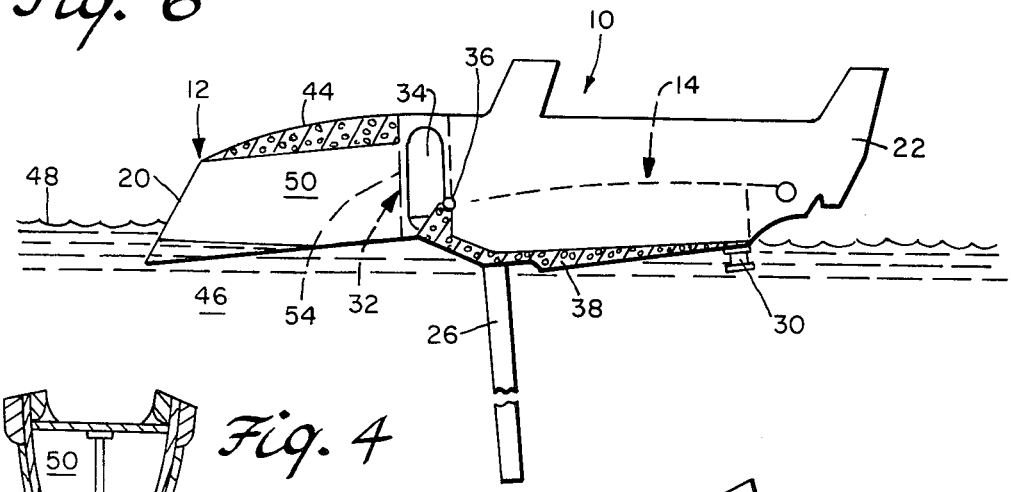
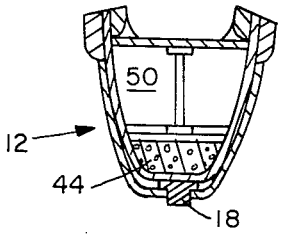
Fig. 4
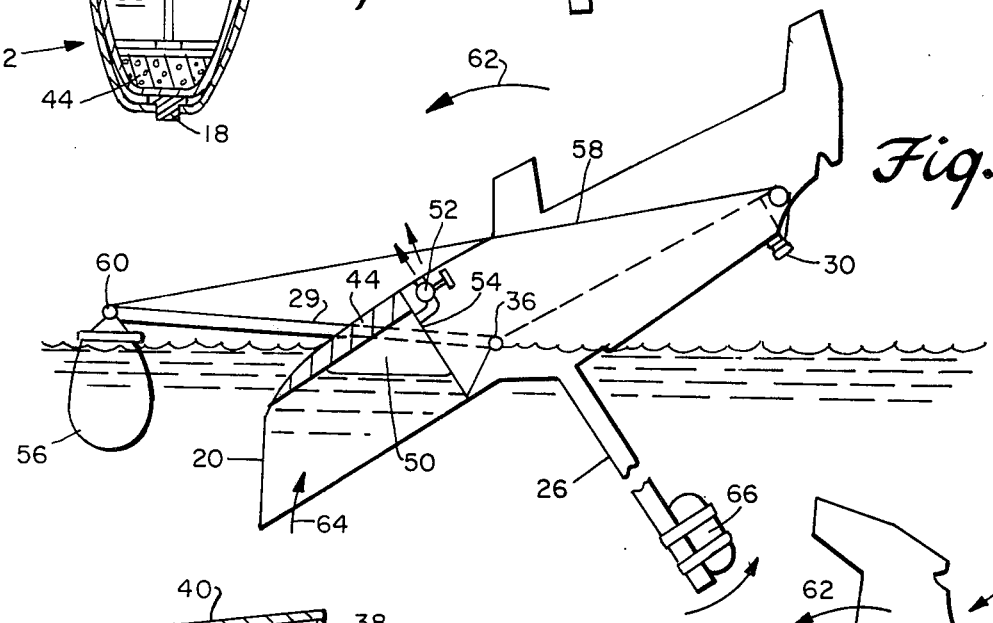
Fig. 7
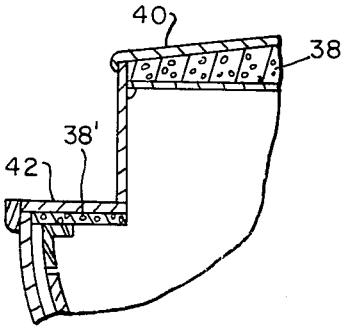
Fig. 5
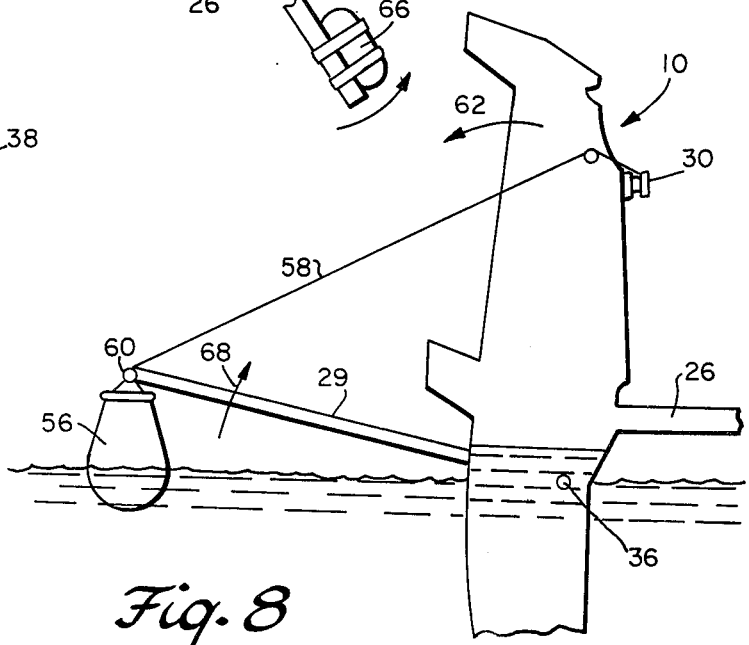
Fig. 8

MULTI-HULL SELF RESCUING SYSTEM

BACKGROUND OF THE INVENTION

This invention relates to relatively small marine craft and an associated method whereby the craft may be inverted from a capsized position to an upright position by the crew.

A serious problem in the handling of small marine craft resides in the virtual impossibility of the crew to right the craft once it has been capsized. This problem is of particular concern in connection with sailboats that are more susceptible to capsizing because of their dependence on wind for propulsion and the relatively low draft of the hull construction. The use of multi-hull construction has been proposed in order to improve the stability of the sailboat in an effort to minimize the capsizing problem. Multi-hull sailboats such as catamarans provide, however, a false sense of security in regard to the capsizing problem. The righting of a capsized craft of the catamaran type is expressly dealt with in U.S. Pat. No. 3,865,061 to Newman. The righting method disclosed in the Newman patent involves lateral displacement of the craft about its longitudinal axis. Further, the righting method as disclosed in the Newman patent is limited to a multi-hull boat that is only partially capsized and requires a pivoted mounting for the mast and a special cable system associated therewith.

It is, therefore, an important object of the present invention to provide a self rescuing system for marine craft whereby the crew may, without assistance, invert the craft to its upright position so that the craft may get underway after being capsized as a result of a storm or the like.

SUMMARY OF THE INVENTION

In accordance with the present invention, a relatively small marine craft such as, but not necessarily restricted to, a catamaran type sailboat is provided with buoyancy support means in the form of an air sealed bag or the like fixedly mounted at a location intermediate the bow and stern to floatingly establish a laterally extending rotational axis about which the craft may be angularly displaced in one direction from a capsized position. Foam flotation layers are fixed to the bottom of the hull or hulls forwardly of this rotational axis while foam layers are fixed to the underside of the deck and cabin top rearwardly of the rotational axis in order to maintain the craft in a floating condition while capsized and yet permit angular displacement of the craft in said one direction about the aforementioned rotational axis. Angular displacement from the capsized position is initiated by venting air entrapped within cavities located in the craft forwardly of the rotational axis causing the bow to descend into the water until the craft assumes a stabilized position intermediate the capsized and upright positions with the stern end extending upwardly out of the water. In this intermediate position, water drains from those cavities of the craft positioned above the water.

Prior to initiating the craft inverting operation, a boom is pivotally connected to the craft adjacent to the aforementioned rotational axis and a counterweight is suspended from the boom forwardly of the bow. With the counterweight immersed in the water, the rotational axis for the craft is established during the initial inverting stage of operation. By means of a winch or some machine having a suitable mechanical advantage, the boom is pivotally displaced upwardly relative to the craft while in its intermediate stabilized position in order to raise the counterweight out of the water and thereby produce a turning moment to resume angular displacement of the craft in the same rotational direction toward the upright position. The counterweight elevating force or turning moment may be gradually reduced as the craft approaches its upright position by lowering the counterweight into the water. The boom and counterweight are dismantled once the craft has been refloated in its upright position and the hull cavities fully drained of water.

Modification or construction of a craft in accordance with the invention to maintain it floating in the capsized position with air entrapped therein, provides continued life support and protection for the crew and passengers for an indefinite period of time in order to permit the crew to recover from traumatic experiences and to prepare for the craft inverting procedure hereinbefore described, including the pivotal attachment of the counterweight carrying boom, venting of trapped air and elevating the counterweighted boom.

BRIEF DESCRIPTION OF THE DRAWING FIGURES

Reference is hereinafter made to the accompanying drawings wherein like numerals refer to like parts throughout.

FIG. 1 is a partial side elevational view of a typical catamaran type of sailboat constructed in accordance with the present invention.

FIG. 2 is a top plan view of the sailboat shown in FIG. 1.

FIG. 3 is an enlarged partial sectional view taken substantially through a plane indicated by section line 3—3 in FIG. 2.

FIG. 4 is an enlarged partial sectional view taken substantially through a plane indicated by section line 4—4 in FIG. 2.

FIG. 5 is an enlarged partial sectional view taken substantially through a plane indicated by section line 5—5 in FIG. 2.

FIGS. 6 through 10 are simplified side sectional views of the sailboat in different stages of being inverted from a capsized to an upright position.

DETAILED DESCRIPTION OF A PREFERRED EMBODIMENT

Figure 9:
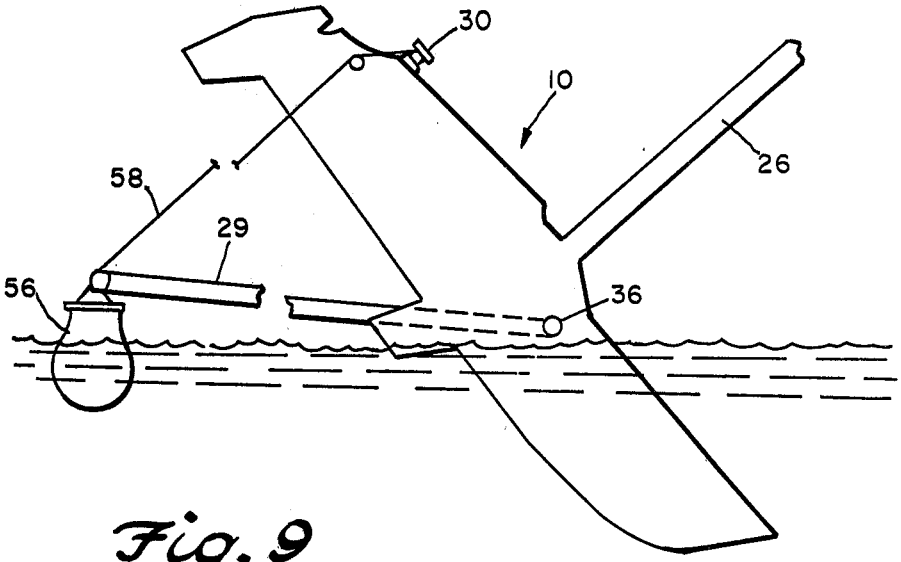

Referring now to the drawings in detail, FIGS. 1 and 2 illustrate a marine craft generally referred to by reference numeral 10, of the catamaran sailboat type. The craft 10 includes a pair of laterally spaced hull sections 12 interconnected by a deck and cabin structure generally referred to by reference numeral 14. A stabilizer 16 depends from each of the hull sections below the bottom keel 18 intermediate the bow and stern ends 20 and 22. As usual, each hull section has a rudder 24 pivotally connected to the stern end and a mast 26 extending vertically upwardly from the structure 14 approximately midway between the bow and stern ends. A boom 28 is also shown in FIG. 1 pivotally connected to and extending rearwardly from the mast 26. Cable winches 30 are mounted on the structure 14 adjacent to the stern end as shown.

In accordance with the present invention, as more particularly shown in FIG. 3, the hull sections 20 are interconnected at the forward end of the deck and cabin structure 14 by buoyancy support means 32 within which an air containing tank 34 or air bag is mounted for purposes to be explained hereinafter. Also mounted adjacent the forward end of the structure 14 as shown in FIG. 3, is a pivot means in the form of a pivotal connector 36 for a boom to be utilized in a manner hereinafter explained. The pivotal connector 36 establishes a rotational axis extending transversely or laterally of the longitudinal axis of the craft and located forwardly of the mast 26. As also shown in FIG. 3, the top of the structure 14 includes a layer of foam material 38 for flotation purposes as will be hereinafter explained. The foam layer 38 lines the underside of the cabin top 40 as more clearly seen in FIG. 5, while additional foam layers 38' may be placed underneath the deck portions 42 of the structure as shown in FIG. 5. Thus, the upper portions of the craft in its upright position will be lined with flotation foam layers which extend substantially from the rotational axis established by the pivotal connector 36 rearwardly toward the stern end. Foam flotation layers 44 also line the bottoms of the hull sections 12 forwardly of the rotational axis as more clearly seen in FIG. 4. Except for the use of the foam layers 38, 38' and 44, the craft is otherwise constructed in accordance with sound marine architectural principles.

Referring now to FIG. 6, the craft 10 is shown floating in a capsized position on a body of water 46. Because of the buoyancy support means 32 and the foam layers 38, 38' and 44, flotation of the craft in the capsized position with air entrapped therein is assured. Accordingly, the craft when capsized as a result of a storm, tidal wave or some other extreme environmental condition, will support the crew and occupants of the boat above the surface 48 of the water for an indefinite period of time so that they may recover from the traumatic experience and prepare for righting the capsized craft. As will be observed from FIG. 6, the placement of the foam layers is such that the craft is orientated with the bow end 20 of the hulls slightly below the surface of the water entrapping air within bow chambers 50 forwardly of the flotation bag 34 while the rotational axis will be positioned adjacent the surface 48 of the water. The rear portion of the craft aft of the bag 34 will be maintained above the surface of the water by the flotation foam layers 38 and 38' so that the crew and occupants may rest on the underside of the deck and cabin structure 14 between the hull sections 12. The occupants of the craft or crew will thereby have easy access to the auxiliary pivotal connector 36 aforementioned as well as a vent valve 52 located on the rear side of the partition wall 54 of buoyancy support means 32 in front of which the bow air chambers 50 are formed.

To begin the craft righting procedure, an extra spinnaker boom 29 carried on the craft 10 is pivotally connected to the pivotal connector 36 as shown in FIG. 7. Thus, the boom will extend forwardly from the connector 36 between the hulls. At the forward end of the boom spaced forwardly of the bow ends 20 of the craft, a counterweight in the form of water bag 56 is suspended. In one embodiment of the invention, the weight of the water-filled bag is approximately 1,000 lbs. resulting in the bag floating with substantially the entire volume thereof immersed in the water. A cable 58 extends from the water bag suspension end 60 of the boom to one of the winches 30. Thus, in the position of the boom and counterweight 56 as shown in FIG. 7, a rotational axis at the pivotal connector 36 is established for the craft about which the craft is angularly displaced from the capsized position in a counter-clockwise direction as indicated by arrow 62 in FIG. 7. Angular displacement is initiated by opening the vent valve 52 to vent the air entrapped in chambers 50 and permit entry of water into the chambers as indicated by arrow 64 in FIG. 7. In order to augment angular displacement from the capsized position, a buoyancy body or air bag 66 is mounted at the end of the mast 26 immersed within the water. For example, the air bag 66 may be secured to the mast to establish a 1,000 lb. buoyancy force multiplied by a lever arm corresponding to an 18 foot mast to thereby produce a substantial turning moment. The craft will accordingly rotate about the axis established by pivotal connector 36 until it reaches a vertical stabilized position as shown in FIG. 8 with the mast 26 elevated out of the water. In this vertical stabilized position, water will drain from the deck and cabin structure in preparation for subsequent angular displacement of the craft toward the upright position.

Figure 10:
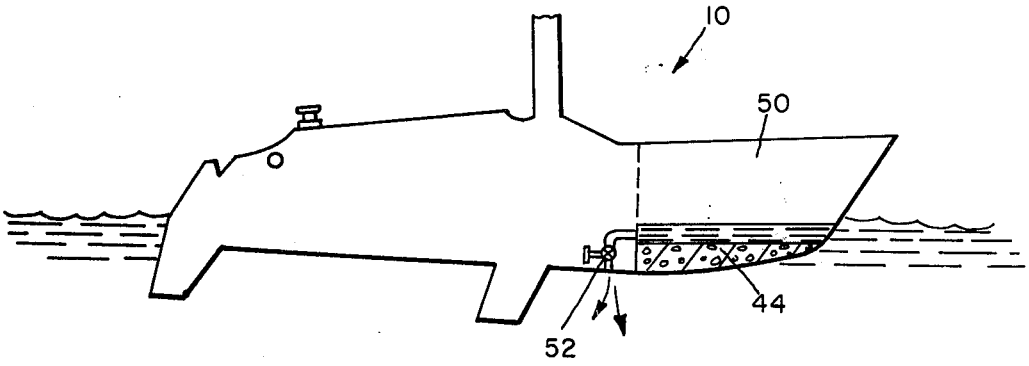

With continued reference to FIG. 8, the boom 29 is pivotally displaced in a clockwise direction relative to the craft as indicated by arrow 68 by means of the winch 30 or any other suitable machine operating through the cable 58 at the desired mechanical advantage. The counterweight water bag 56 is thereby elevated out of the water to produce a turning moment causing continued angular displacement of the craft from its intermediate stabilized position shown in FIG. 8 toward the upright position. Accordingly, when the craft reaches an unbalanced position such as shown in FIG. 9, it will continue rotation until it reaches the upright position as shown in FIG. 10. The turning moment produced by the counterweight 56 may therefore be gradually reduced by lowering it into the water as shown in FIG. 9. When the craft reaches the upright position as shown in FIG. 10, any water remaining in the bow chambers 50 may be drained through valve 52 as shown and the boom 29 dismantled. The crew may then prepare the craft for continued sailing.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A method of inverting a marine craft having air entrapped therein while floating in a capsized condition on a body of water, comprising the steps of: pivotally connecting an elongated boom to the capsized craft; suspending a counterweight from said boom substantially immersed in the water to establish a rotational axis for the craft; venting air entrapped in the craft to admit water therein causing angular displacement in one direction about said rotational axis until the craft reaches a stabilized intermediate position; and pivotally displacing the boom relative to the craft to raise the counterweight out of the water causing continued angular displacement in said one direction from the intermediate position until the craft is floating in an upright position.

2. The method of claim 1, wherein said craft includes a mast substantially elevated out of the water in said intermediate position.

3. The method of claim 2, including the step of placing a buoyancy body on the mast to augment the turning moment causing angular displacement of the craft to the intermediate position.

4. The method of claim 2, wherein said craft has cavities from which water drains in the intermediate position of the craft.

5. The method of claim 4, including the step of placing a buoyancy body on the mast to augment the turning moment causing angular displacement of the craft to the intermediate position.

6. The method of claim 5, wherein the bow of the craft descends into the water as the craft is angularly displaced to the intermediate position.

7. The method of claim 1, wherein said craft has cavities from which water drains in the intermediate position of the craft.

8. The method of claim 1, wherein the bow of the craft descends into the water as the craft is angularly displaced to the intermediate position.

9. In combination with a marine craft having a keel extending between bow and stern ends, apparatus for inverting the craft from a capsized position in water to an upright position, including buoyancy support means mounted within the craft intermediate said bow and stern ends for establishing a rotational axis about which the craft is angularly displaceable between the capsized and upright positions, flotation means restrictively mounted by the craft on opposite sides of the rotational axis for enabling angular displacement of the craft relative to said rotational axis, and means for inducing said angular displacement.

10. The combination of claim 9, wherein said flotation means comprises a foam layer on the keel extending substantially from the rotational axis toward the bow end of the craft and a foam layer on the deck extending substantially from the rotational axis toward the stern end.

11. The combination of claim 10, wherein said angular displacement inducing means includes vent means for selectively venting air entrapped in the craft while in the capsized position to permit entry of water into cavities on one of said opposite sides of the rotational axis.

12. The combination of claim 11, wherein said angular displacement inducing means further includes an elongated boom, means pivotally connecting the boom to the craft at said rotational axis, a counterweight suspended from the boom in spaced relation to the craft and mechanical means connected to the boom for pivotal displacement thereof relative to the craft.

13. The combination of claim 12, including a mast extending substantially perpendicular to the craft spaced aft of the rotational axis.

14. The combination of claim 13, wherein said craft is of the catamaran type having two hulls interconnected by the deck aft of the rotational axis, said boom extending forwardly from the craft between the two hulls to suspend the counterweight in spaced relation to the bow end.

15. The combination of claim 9, wherein said angular displacement inducing means includes vent means for selectively venting air entrapped in the craft while in the capsized position to permit entry of water into cavities on one of said opposite sides of the rotational axis.

16. The combination of claim 15, wherein said angular displacement inducing means further includes an elongated boom, means pivotally connecting the boom to the craft at said rotational axis, a counterweight suspended from the boom in spaced relation to the craft and mechanical means connected to the boom for pivotal displacement thereof relative to the craft.

17. The combination of claim 16, wherein said craft is of the catamaran type having two hulls interconnected by the deck aft of the rotational axis, said boom extending forwardly from the craft between the two hulls to suspend the counterweight in spaced relation to the bow end.

18. The combination of claim 9, wherein said angular displacement inducing means includes an elongated boom, means pivotally connecting the boom to the craft at said rotational axis, a counterweight suspended from the boom in spaced relation to the craft and mechanical means connected to the boom for pivotal displacement thereof relative to the craft.

19. The combination of claim 18, wherein said craft is of the catamaran type having two hulls interconnected by the deck aft of the rotational axis, said boom extending forwardly from the craft between the two hulls to suspend the counterweight in spaced relation to the bow end.

20. In combination with a marine craft having an elongated hull extending between bow and stern ends, means for inverting the craft between capsized and upright floating positions in a body of water, including counterweight means pivotally connected to the hull intermediate said bow and stern ends for establishing a rotational axis, buoyancy support means mounted within the hull for floatingly positioning the rotational axis adjacent the surface of the water in the capsized position of the craft, flotation means mounted on the hull for floatingly orientating the craft in the capsized position with the bow end below the water surface and the stern end elevated above the water surface, means for selectively venting air entrapped within the hull adjacent the bow end to induce angular displacement substantially about said rotational axis from the capsized position to a stabilized position intermediate the capsized and upright positions, and mechanical means for pivotally displacing the counterweight means relative to the hull about said rotational axis to induce continued angular displacement of the hull from the intermediate stabilized position to the upright position.

* * * * *